US008485804B2

(12) United States Patent
Hossain et al.

(10) Patent No.: US 8,485,804 B2
(45) Date of Patent: Jul. 16, 2013

(54) SINGLE SCREW COMPRESSOR STRUCTURE AND METHOD OF ASSEMBLING SINGLE SCREW COMPRESSOR INCLUDING THE SAME

(75) Inventors: Mohammod Anwar Hossain, Sakai (JP); Kaname Ohtsuka, Sakai (JP); Masanori Masuda, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 789 days.

(21) Appl. No.: 12/665,047

(22) PCT Filed: Jun. 20, 2008

(86) PCT No.: PCT/JP2008/061311

§ 371 (c)(1),
(2), (4) Date: Dec. 17, 2009

(87) PCT Pub. No.: WO2009/001765

PCT Pub. Date: Dec. 31, 2008

(65) Prior Publication Data

US 2010/0183468 A1 Jul. 22, 2010

(30) Foreign Application Priority Data

Jun. 22, 2007 (JP) ..... 2007-164738

(51) Int. Cl.

| | |
|---|---|
| ***F01C 1/08*** | (2006.01) |
| ***F01C 1/24*** | (2006.01) |
| ***F04C 2/00*** | (2006.01) |
| ***F04C 18/00*** | (2006.01) |

(52) U.S. Cl.
USPC ..... 418/194; 418/178; 418/179

(58) Field of Classification Search
USPC ..... 418/194–197, 152, 178–79, 201.1, 418/201.3
See application file for complete search history.

(56) References Cited

U.S. PATENT DOCUMENTS

| | | | | |
|---|---|---|---|---|
| 3,133,695 | A * | 5/1964 | Zimmern | 418/87 |
| 3,551,082 | A | 12/1970 | Zimmern | |
| 3,632,239 | A | 1/1972 | Zimmern | |
| RE30,400 | E | 9/1980 | Zimmern | |
| 4,373,881 | A * | 2/1983 | Matsushita | 418/195 |
| 4,981,424 | A * | 1/1991 | Bein | 418/99 |
| 5,533,887 | A * | 7/1996 | Maruyama et al. | 418/201.3 |
| 6,257,839 | B1 * | 7/2001 | Fang et al. | 417/283 |
| 6,398,532 | B1 | 6/2002 | Zha et al. | |
| 7,658,600 | B2 * | 2/2010 | Fujita et al. | 418/178 |
| 8,079,144 | B2 * | 12/2011 | Holden | 29/888.021 |

FOREIGN PATENT DOCUMENTS

| | | |
|---|---|---|
| JP | 48-12203 | 4/1973 |
| JP | 51-37605 U | 3/1976 |

(Continued)

*Primary Examiner* — Thomas Denion
*Assistant Examiner* — Steven D Shipe
(74) *Attorney, Agent, or Firm* — Global IP Counselors

(57) ABSTRACT

A single screw compressor structure includes a screw rotor and a casing, which houses the screw rotor. A tapered outer circumferential surface of the screw rotor has a plurality of helical grooves, with an outer diameter that increases from an inlet side toward a discharge side. The casing includes an outer tube member having a circular inner hole to form an interior, and an inner tube member is fixed to the interior of the outer tube member. The inner tube member has a tapered inner surface that opposes the tapered outer circumferential surface of the screw rotor. A single screw compressor further including a gate rotor is assembled by adjusting mesh between the screw rotor and the gate rotor, aligning the tapered outer and inner circumferential surfaces relative to one another, and integrally coupling the outer and inner tube members to each other.

10 Claims, 7 Drawing Sheets

FOREIGN PATENT DOCUMENTS

| | | | |
|---|---|---|---|
| JP | 63-154891 | A | 6/1988 |
| JP | 02-153294 | A | 6/1990 |
| JP | 03-275997 | A | 12/1991 |
| JP | 2000-034991 | A | 2/2000 |
| JP | 2002-202080 | A | 7/2002 |
| JP | 2004-324601 | A | 11/2004 |

* cited by examiner

SINGLE SCREW COMPRESSOR STRUCTURE AND METHOD OF ASSEMBLING SINGLE SCREW COMPRESSOR INCLUDING THE SAME

CROSS-REFERENCE TO RELATED APPLICATIONS

This U.S. National stage application claims priority under 35 U.S.C. §119(a) to Japanese Patent Application Nos. 2007-164738, filed in Japan on Jun. 22, 2007, the entire contents of which are hereby incorporated herein by reference.

TECHNICAL FIELD

The present invention relates to a single screw compressor and a method of assembling the same.

BACKGROUND ART

In the conventional art, various compressors for compressing a compressible medium such as the refrigerant of a freezer have been proposed, and, among these, the single screw compressor is known to feature little vibration, low noise, and high reliability.

A single screw compressor according to Japanese Unexamined Patent Application Publication No. 2002-202080 comprises: a cylindrically shaped screw rotor, the outer circumferential surface of which has a plurality of helical grooves; at least one gate rotor, which rotates while meshing with the screw rotor; and a casing, which houses the screw rotor. The compressible medium, such as a refrigerant, is fed to the helical grooves of the screw rotor, which rotates inside the casing, is compressed inside a space defined by the helical grooves, teeth of the gate rotor, and the casing, and is discharged from a discharge port of the casing.

In addition, a single screw compressor according to U.S. Reissue Pat. No. 30400 comprises: a tapered or a reverse tapered screw rotor, the outer diameter of which changes from an inlet side to a discharge side; and a pinion, which rotates while meshing with the helical grooves of the screw rotor. In the single screw compressor according to the U.S. Reissue Pat. No. 30400 as well, the compressible medium, such as the refrigerant, is fed to the helical grooves of the screw rotor rotating inside the casing, is compressed inside a space defined by the helical grooves, the teeth of the pinion, and the casing and is discharged from a discharge port of the casing.

SUMMARY OF THE INVENTION

<Technical Problem>

Nonetheless, the tapered screw rotor according to the abovementioned U.S. Reissue Pat. No. 30400 has problems in that it is difficult to align the screw rotor and the pinion (i.e., the gate rotor) and to adjust the gap between the screw rotor and the casing. Consequently, it is difficult to maintain accuracy and to improve productivity.

It is an object of the present invention to provide a single screw compressor wherein a gap between a screw rotor and a casing can be easily adjusted.

<Solution to Problem>

A single screw compressor structure according to a first aspect of the present invention comprises a screw rotor and a casing, which houses the screw rotor. The outer circumferential surface of the screw rotor has a plurality of helical grooves. The screw rotor is a tapered rotor whose outer diameter increases from an inlet side toward a discharge side. The casing comprises an outer tube member, which has a circular inner hole, and an inner tube member. The inner tube member is fixed to the interior of the outer tube member. The inner tube member has a tapered inner surface that opposes the tapered outer circumferential surface of the screw rotor.

In the present aspect, the casing that houses the screw rotor comprises the outer tube member, which has a circular inner hole, and the inner tube member, which is fixed to the interior of the outer tube member and has the tapered inner surface that opposes the tapered outer circumferential surface of the screw rotor; therefore, it is easy to adjust the gap between the outer circumferential surface of the screw rotor and the inner circumferential surface of the casing, and it is possible to reduce leakage of the compressible medium, such as refrigerant, from the gap.

A single screw compressor structure according to the second aspect of the present invention is a single screw compressor structure according to the first aspect of the present invention and further comprises a protruding part and a shim. The protruding part protrudes in radial directions from an end part of the inner tube member. The shim is interposed between an end surface of the outer tube member and an end surface of the protruding part.

The present aspect further comprises the protruding part, which protrudes in the radial directions from the end part of the inner tube member, and the shim, which is interposed between the end surface of the outer tube member and the end surface of the protruding part; therefore, the gap between the screw rotor and the inner tube member inside the outer tube member can be adjusted easily and accurately only by adjusting with the shim the position of the outer tube member relative to the inner tube member while visually observing such externally.

A single screw compressor structure according to the third aspect of the present invention is a single screw compressor structure according to the first aspect of the present invention, wherein at least a tapered inner circumferential surface of the inner tube member is resin coated.

In the present aspect, at least the tapered inner circumferential surface of the inner tube member is resin coated, which makes it possible to adjust the gap optimally and automatically by shaving away part of the resin when the screw rotor is initially rotated.

A single screw compressor structure according to the fourth aspect of the present invention is a single screw compressor structure according to any one of the first through third aspects of the present invention, wherein the inner tube member is fabricated from a material whose linear coefficient of expansion is lower than that of the material of the outer tube member.

In the present aspect, the inner tube member is fabricated from a material whose linear coefficient of expansion is lower than that of the material of the outer tube member, which makes it possible to prevent leakage owing to thermal expansion of the casing.

A single screw compressor structure according to the fifth aspect of the present invention is a single screw compressor structure according to any one of the first through fourth aspects of the present invention, wherein the outer tube member and the inner tube member are coupled by brazing.

In the present aspect, the outer tube member and the inner tube member are coupled by brazing, which makes it possible to fix the inner tube member accurately while maintaining within a prescribed range the gap between the outer circumferential surface of the screw rotor and the inner circumferential surface of the casing and to prevent leakage of the compressible medium.

A method of assembling a single screw according to the sixth aspect of the present invention compressor comprises a tapered screw rotor, whose outer circumferential surface has a plurality of helical grooves and whose outer diameter increases from an inlet side toward a discharge side, a gate rotor, which has a plurality of teeth that mesh with helical grooves of the screw rotor, and a casing, which houses the screw rotor; wherein, the casing comprises an outer tube member, which has a circular inner hole, and an inner tube member, which is fixed to the interior of the outer tube member and has a tapered inner surface that opposes the tapered outer circumferential surface of the screw rotor. The method of assembly comprises a mesh adjusting process, an aligning process, and a coupling process. The mesh adjusting process adjusts the mesh between the screw rotor and the gate rotor. The aligning process aligns the tapered outer circumferential surface of the screw rotor and the tapered inner circumferential surface of the inner tube member of the casing relatively to one another. The coupling process integrally couples the outer tube member and the inner tube member of the casing.

The present aspect is a method of assembling a single screw compressor that comprises: a mesh adjusting process, which adjusts the mesh between the screw rotor and the gate rotor; an aligning process, which aligns the tapered outer circumferential surface of the screw rotor and the tapered inner circumferential surface of the inner tube member of the casing relatively to one another; and a coupling process, which integrally couples the outer tube member and the inner tube member of the casing. Thereby, it is possible to perform assembly while easily adjusting the gap between the outer circumferential surface of the screw rotor and the inner circumferential surface of the casing. As a result, working efficiency can be improved greatly and leakage of the compressible medium from the gap can be reduced.

<Advantageous Effects of Invention>

According to the first aspect of the invention, it is easy to adjust the gap between the outer circumferential surface of the screw rotor and the inner circumferential surface of the casing, and it is possible to reduce leakage of the compressible medium, such as refrigerant, from the gap.

According to the second aspect of the invention, the gap between the screw rotor and the inner tube member inside the outer tube member can be adjusted easily and accurately.

According to the third aspect of the invention, it is possible to adjust the gap optimally and automatically.

According to the fourth aspect of the invention, it is possible to prevent leakage owing to thermal expansion of the casing.

According to the fifth aspect of the invention, it is possible to fix the inner tube member accurately while maintaining within a prescribed range the gap between the outer circumferential surface of the screw rotor and the inner circumferential surface of the casing and to prevent leakage of the compressible medium.

According to the sixth aspect of the invention, it is possible to perform assembly while easily adjusting the gap between the outer circumferential surface of the screw rotor and the inner circumferential surface of the casing; thereby, working efficiency can be improved greatly and leakage of the compressible medium from the gap can be reduced.

DETAILED DESCRIPTION OF THE INVENTION

Figure 1:
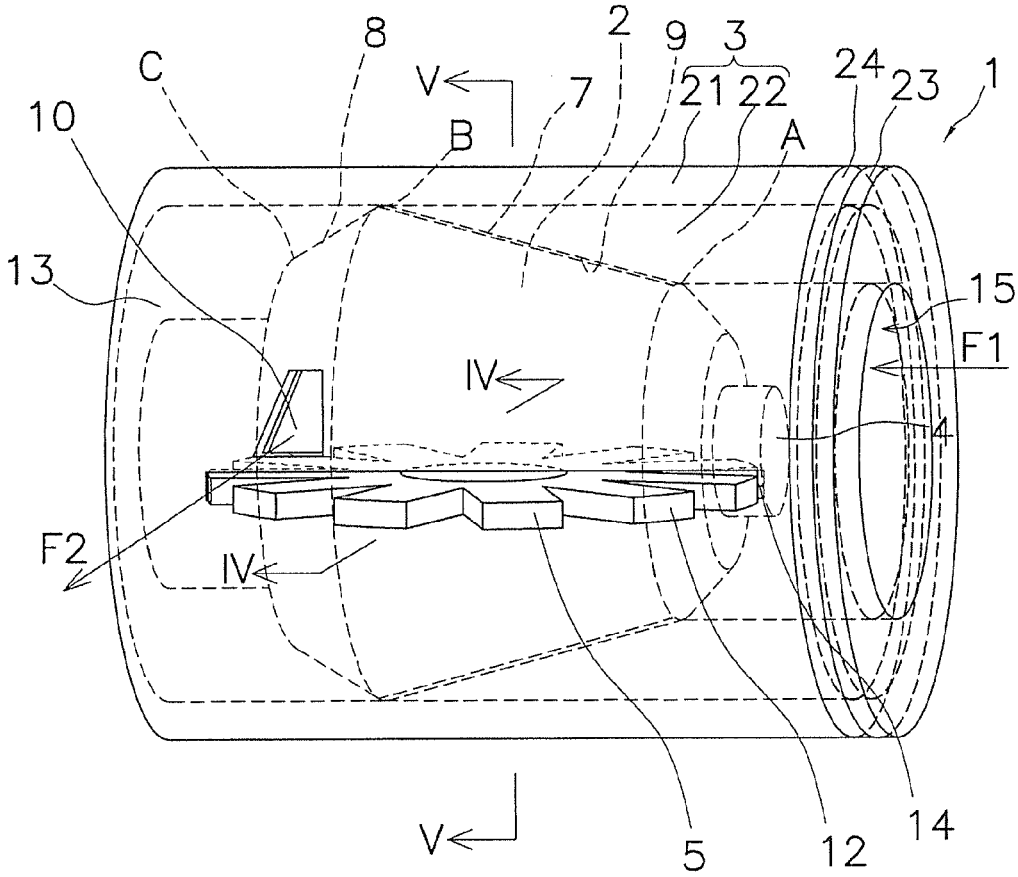
FIG. 1 is a configuration diagram of a single screw compressor according to a first embodiment of the present invention.

The following text explains the embodiments of a single screw compressor of the present invention, referencing the drawings.

First Embodiment

<Configuration of Single Screw Compressor 1>

A single screw compressor 1 according to a first embodiment of the present invention, which is shown in FIG. 1 through FIG. 5, comprises: a screw rotor 2; a casing 3, which houses the screw rotor 2; a shaft 4, which constitutes a rotary shaft of the screw rotor 2; a gate rotor 5; a thrust bearing 13; and a shim 24.

The screw rotor 2 is a tapered rotor, the outer circumferential surface of which has a plurality of helical grooves 6 and the outer diameter of which increases from an inlet side end part A to a discharge side end part C (more specifically, to a maximum outer diameter portion B). The screw rotor 2 is integral with the shaft 4 and is capable of rotating inside the casing 3. The thrust bearing 13 supports the screw rotor 2 along the shaft directions from a direction that proceeds from the discharge side to the inlet side.

In addition, the outer circumferential surface of the screw rotor 2, which has the helical grooves 6, has a main tapered portion 7, the outer diameter of which tapers such that it increases from the inlet side end part A to the maximum outer diameter portion B on the discharge side, and a reverse tapered portion 8, the outer diameter of which tapers in reverse, decreasing on the downstream side of the maximum outer diameter portion B.

The casing 3 is a tubular member that rotatably houses the screw rotor 2 and the shaft 4. The casing 3 comprises an outer tube member 21, which has a circular inner hole, and an inner tube member 22.

The inner tube member 22 is a tubular member that is fixed to the interior of the outer tube member 21 and has a tapered inner circumferential surface part 9 that opposes the tapered outer circumferential surface of the screw rotor 2. An inner diameter of the tapered inner circumferential surface part 9 changes to a taper partially in the inner tube member 22. Furthermore, the tapered inner circumferential surface part 9 and the outer circumferential surface of the main tapered portion 7 of the screw rotor 2 are spaced apart by a prescribed gap.

The outer tube member 21 and the inner tube member 22 are both fabricated from a metal material. The inner tube member 22 is fabricated from a material whose linear coefficient of expansion is lower than that of the material of the outer tube member 21. This makes it possible to suppress thermal expansion of the inner tube member 22 during the operation of the compressor and thereby to prevent the gap between the inner tube member 22 and the outer circumferential surface of the screw rotor 2 from enlarging and thus the compressible medium, such as refrigerant, from leaking out.

For example, fabricating the outer tube member 21 from a metal material such as gray cast iron or ductile cast iron and fabricating the inner tube member 22 from a metal material such as stainless steel, which is a material whose linear coefficient of expansion is lower than that of the material of the outer tube member 21, makes it possible to prevent the gap between the inner tube member 22 and the outer circumferential surface of the screw rotor 2 from enlarging and thus to prevent the compressible medium, such as refrigerant, from leaking out.

An end part on the outer side of the inner tube member 22 comprises a protruding part 23, which protrudes in the radial directions. An end surface 23*a* on the inner side of the protruding part 23 opposes an end surface 21*a* on the outer side of the outer tube member 21.

The shim 24 is an apertured discoidal shim fabricated from, for example, a thin metal plate and the like. A plurality of shims of thicknesses that differ in increments of 10 microns is prepared beforehand, and the shim 24 of an appropriate thickness is selected therefrom. The shim 24 is disposed such that it is interposed between the end surface 21*a* of the outer tube member 21 and the end surface 23*a* of the protruding part 23. Thereby, the relative position between the outer tube member 21 and the inner tube member 22 can be adjusted. As a result, the gap between the inner tube member 22 inside the outer tube member 21 and the outer circumferential surface of the screw rotor 2 can be adjusted.

After the gap is adjusted by sliding the inner tube member 22, the inner tube member 22 is fixed to the outer tube member 21 by brazing.

In addition, a discharge port 10, which is for discharging the refrigerant compressed inside the casing 3, is opened in the casing 3 at a location that opposes the reverse tapered portion 8.

The gate rotor 5 is a rotary body that comprises a plurality of teeth 12, which mesh with the grooves 6 of the screw rotor 2, and is capable of rotating around a rotary shaft (not shown) that is substantially orthogonal to the shaft 4, which is the rotary shaft of the screw rotor 2. The teeth 12 of the gate rotor 5 pass through a slit 14, which is formed in the casing 3, and are capable of meshing with the helical grooves 6 of the screw rotor 2 inside the casing 3.

The screw rotor 2 is provided with six grooves 6, and the gate rotor 5 is provided with eleven teeth 12. Because the number of the grooves 6, that is, six, and the number of the teeth 12, that is, eleven, are coprime, when the single screw compressor 1 operates, each of the teeth 12 can mesh with each of the grooves 6 in turn.

<Explanation of Method of Assembling the Single Screw Compressor 1>

The screw rotor compressor 1 is assembled according to the process described below.

In the state prior to assembly, the gate rotor 5 is rotatably supported by a rotary shaft (not shown) outside of the casing 3. The teeth 12 of the gate rotor 5 pass through the slit 14 in the outer circumferential surface of the outer tube member 21 of the casing 3 and project into the outer tube member 21.

First, the screw rotor 2 is inserted inside the outer tube member 21 of the casing 3 and is supported by the thrust bearing 13. In this state, the mesh between the screw rotor 2 and the gate rotor 5 is adjusted (a mesh adjusting process). In this mesh adjusting process, the depth of the mesh between the grooves 6 of the screw rotor 2 and the teeth 12 of the gate rotor 5 is adjusted to a prescribed depth such that the gate rotor 5 can rotate smoothly in conjunction with the rotation of the screw rotor 2.

Next, the main tapered portion 7, which is the tapered outer circumferential surface of the screw rotor 2, and the tapered inner circumferential surface part 9 of the inner tube member 22 of the casing 3 are aligned relatively to one another (an aligning process). At this time, because the shim 24 is interposed between the end surface 21*a* of the outer tube member 21 and the end surface 23*a* of the protruding part 23, it is possible to adjust the relative position between the outer tube member 21 and the inner tube member 22 while visually observing such from the outside. Thereby, the gap between the inner tube member 22 inside the outer tube member 21 and the outer circumferential surface of the screw rotor 2 is adjusted.

Thereafter, the outer tube member 21 of the casing 3 and the inner tube member 22 are coupled integrally by brazing (a coupling process).

Thereby, it is possible to perform such an assembly while easily adjusting the gap between the outer circumferential surface of the screw rotor 2 and the inner circumferential surface of the casing 3, which in turn makes it possible to greatly improve working efficiency and, moreover, to reduce leakage of the compressible medium from the gap.

<Explanation of Operation of Single Screw Compressor 1>

Figure 2:
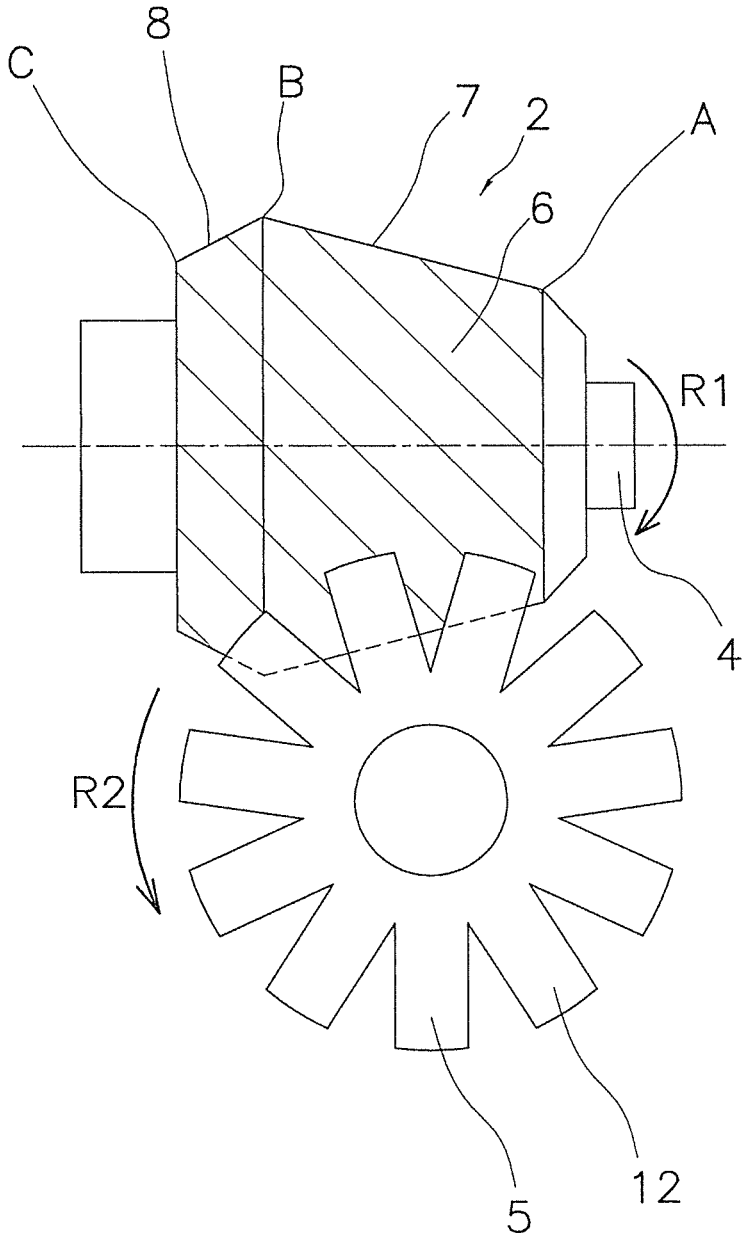
FIG. 2 is a front view of a screw rotor and a gate rotor shown in FIG. 1.
Figure 3:
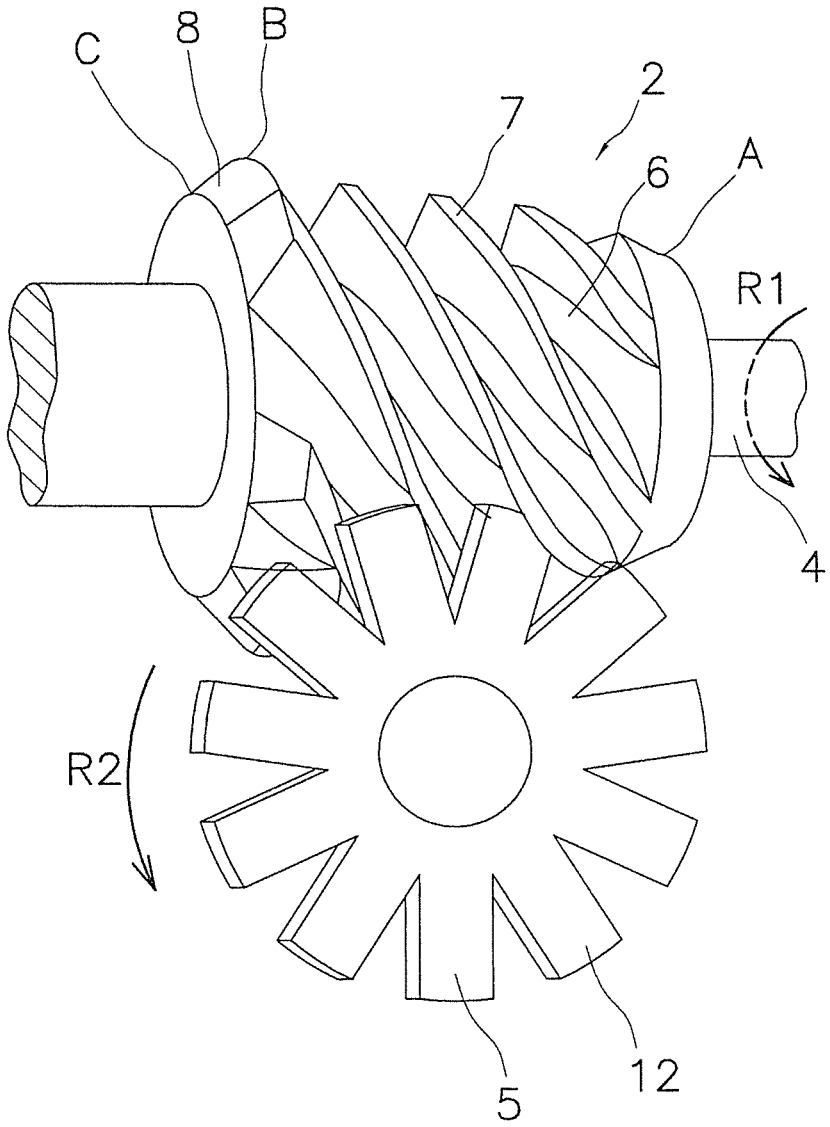
FIG. 3 is a perspective view of the screw rotor and the gate rotor shown in FIG. 1.
Figure 4:
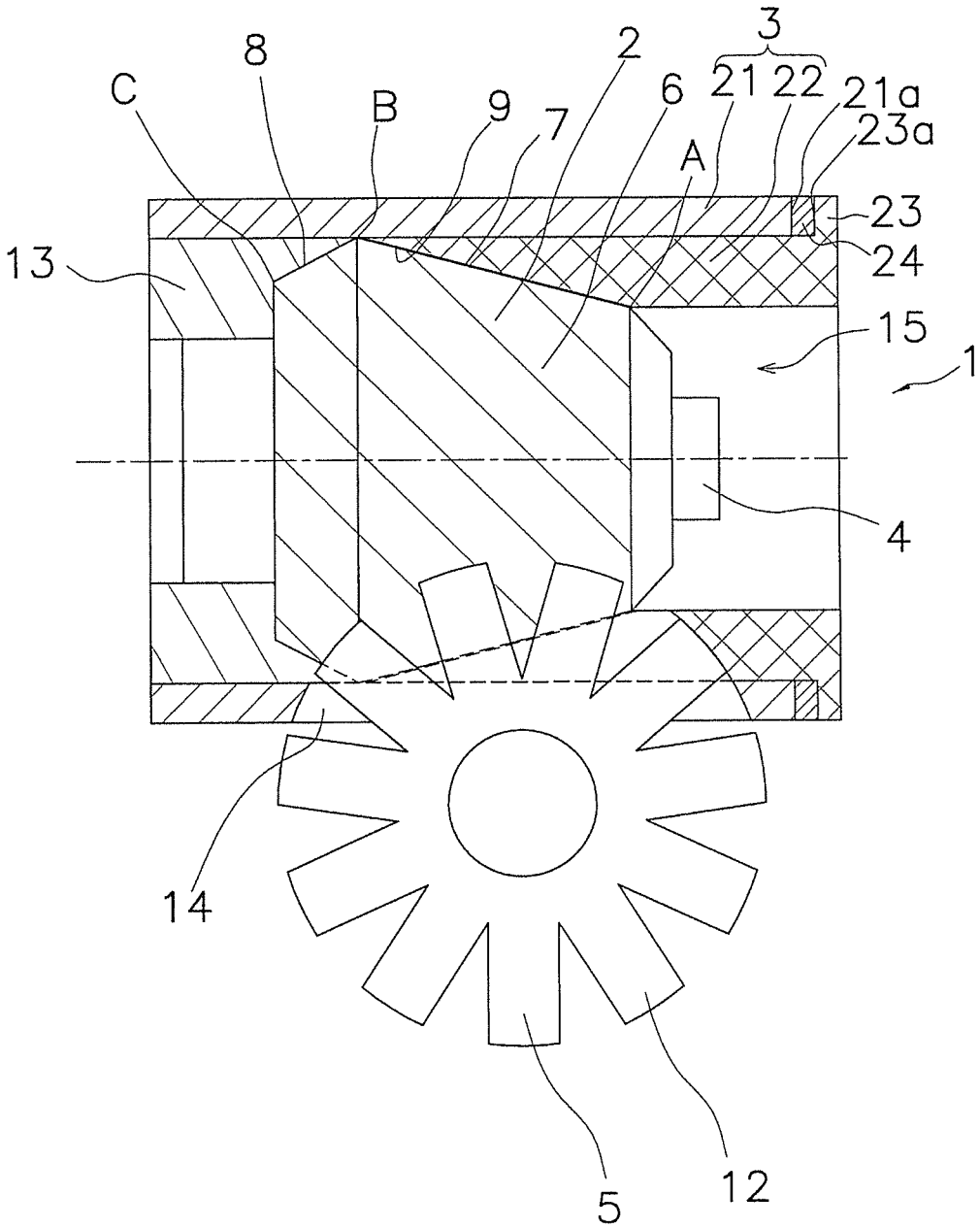
FIG. 4 is a cross sectional view, taken along the IV-IV line in FIG. 1, of the single screw compressor.
Figure 5:
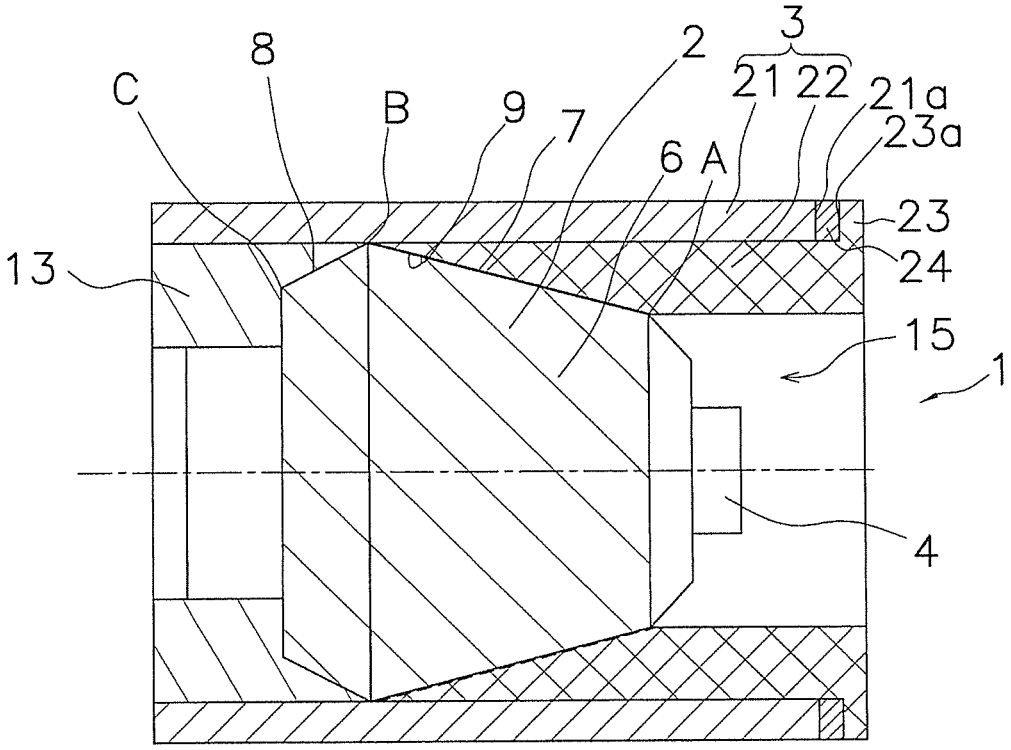
FIG. 5 is a cross sectional view, taken along the V-V line in FIG. 1, of the single screw compressor.

When the shaft 4 receives the rotational driving force from a motor (not shown) outside of the casing 3, the screw rotor 2 rotates in the direction of an arrow R1 (refer to FIG. 2 and FIG. 3). At this time, the teeth 12 of the gate rotor 5, which mesh with the helical grooves 6 of the screw rotor 2, are pressed to the inner walls of the helical grooves 6 and thereby the gate rotor 5 rotates in the direction of an arrow R2. At this time, the volume of a compression chamber, which is partitioned and defined by an inner surface of the casing 3, the grooves 6 of the screw rotor 2, and the teeth 12 of the gate rotor 5, decreases.

By taking advantage of this decrease in the volume, a refrigerant F1 (refer to FIG. 1), which is the refrigerant prior to compression, is introduced via an inlet side opening 15 in the casing 3 and is guided to the compression chamber immediately before the grooves 6 and the teeth 12 mesh with each other, at which time the volume of the compression chamber while the grooves 6 and the teeth 12 mesh with each other is reduced, which compresses the refrigerant; subsequently, immediately after the grooves 6 and the teeth 12 are unmeshed, compressed refrigerant F2 (refer to FIG. 1) is discharged from the discharge port 10.

At this time, the force exerted by the refrigerant in the main tapered portion 7 that pushes the screw rotor 2 from the inlet side end part A to the discharge side end part C in the shaft directions attenuates the force exerted by the refrigerant that pushes the reverse tapered portion 8 back from the discharge side end part C to the inlet side end part A. Thereby, it is possible to reduce the load in the shaft directions that acts on the screw rotor 2.

Furthermore, the main tapered portion 7 and the reverse tapered portion 8 are designed such that the force exerted by the refrigerant that pushes the main tapered portion 7 is always greater than the force exerted by the refrigerant that pushes the reverse tapered portion 8 so that the load in the shaft directions that acts on the screw rotor 2 does not fluctuate in the longitudinal directions (i.e., in the A→C direction and in the CA direction in FIG. 2).

<Features of the First Embodiment>

(1) In the single screw compressor 1 according to the first embodiment, the casing 3 that houses the screw rotor 2 comprises the outer tube member 21, which has a circular inner hole, and the inner tube member 22 which is fixed to the interior of the outer tube member 21 and, which comprises the tapered inner circumferential surface part 9, which is the tapered inner surface that opposes the tapered outer circumferential surface of the screw rotor 2; therefore, it is easy to adjust the gap between the outer circumferential surface of the screw rotor 2 and the inner circumferential surface of the casing 3, and it is possible to reduce leakage of the compressible medium, such as refrigerant, from the gap. Moreover, a structure that facilitates adjustment of the gap makes it possible to decrease assembly time and costs.

(2) In the single screw compressor 1 according to the first embodiment, the shim 24 is interposed between the end surface 21*a* of the outer tube member 21 and the end surface 23*a* of the protruding part 23, which makes it possible to adjust the relative position between the outer tube member 21 and the inner tube member 22 while visually observing such from the outside. Thereby, the gap between the inner tube member 22 and the outer circumferential surface of the screw rotor 2 inside the outer tube member 21 can be adjusted easily and accurately. As a result, it is possible to reliably prevent the compressible medium, such as refrigerant, from leaking out.

(3) In the first embodiment, the inner tube member 22 is fabricated from a material whose linear coefficient of expansion is lower than that of the material of the outer tube member 21, which makes it possible to prevent leakage of the refrigerant owing to thermal expansion of the outer tube member 21.

(4) In the first embodiment, the outer tube member 21 and the inner tube member 22 are coupled by brazing, which makes it possible to accurately fix the inner tube member 22 while maintaining the gap between the outer circumferential surface of the screw rotor 2 and the inner circumferential surface of the casing 3 within a prescribed range; moreover, the compressible medium, such as refrigerant, tends not to leak out.

(5) The method of assembling the single screw compressor 1 according to the first embodiment comprises: a mesh adjusting process, which adjusts the mesh between the screw rotor 2 and the gate rotor 5; an aligning process, which aligns the tapered outer circumferential surface of the screw rotor 2 and the tapered inner circumferential surface of the inner tube member 22 of the casing 3 relatively to one another; and a coupling process, which integrally couples the outer tube member 21 of the casing 3 and the inner tube member 22. Thereby, assembly can be performed while easily adjusting the gap between the outer circumferential surface of the screw rotor 2 and the inner circumferential surface of the casing 3, which makes it possible to greatly improve working efficiency and to reduce leakage of the compressible medium from the gap.

<Modified Examples of First Embodiment>

(A) Furthermore, in the first embodiment, the gap between the inner tube member 22 and the outer circumferential surface of the screw rotor 2 inside the outer tube member 21 is adjusted by sandwiching the shim 24 between the end surface 21*a* of the outer tube member 21 and the end surface 23*a* of the protruding part 23, but the present invention is not limited to this; for example, an adjusting means (e.g., a screw) may be used instead of the shim 24 to adjust the relative position of the inner tube member 22 prior to fixing the inner tube member 22 to the outer tube member 21 while observing such from the outside. In this case, too, the gap between the outer circumferential surface of the screw rotor 2 and the inner circumferential surface of the casing 3 can be adjusted easily, which makes it possible to reduce leakage of the compressible medium, such as refrigerant, from the gap.

(B) In the abovementioned first embodiment, the outer tube member 21 and the inner tube member 22 are coupled by brazing, but the present invention is not limited to this; some other coupling method, for example, welding, may be used as long as the coupling is solid and the compressible medium does not leak out.

(C) The abovementioned first abovementioned embodiment describes an example wherein the inner tube member 22 is a material whose linear coefficient of expansion is lower than that of the material of the outer tube member 21, but the present invention is not limited to this. In a modified example of the first embodiment, even if, for example, the inner tube member 22 is fabricated from a material whose linear coefficient of expansion is the same as that of the material of the outer tube member 21, the thermal expansion of the outer tube member 21 can still prevent the refrigerant from leaking out.

(D) In FIG. 1 through FIG. 4 of the first embodiment, the single screw compressor 1 is drawn as having one gate rotor, but the present invention is not limited to this; in actuality, the number of gate rotors is not limited to one, and a configuration may be adopted wherein a plurality of the gate rotors is provided. Even if a plurality of the gate rotors is provided, the gap between the outer circumferential surface of the screw rotor 2 and the inner circumferential surface of the casing 3 can be adjusted easily by sliding the inner tube member 22, as in the abovementioned first embodiment.

(E) In the abovementioned first embodiment, the casing is a tubular member that comprises the outer tube member 21 and the inner tube member 22, but the present invention is not limited to this; for example, the outer tube member 21 may be of any shape as long as it has a circular inner hole that fixes the inner tube member 22. For example, the shape may be such that it houses the motor.

Second Embodiment

Next, as another embodiment of the present invention, an additional configuration wherein the gap between the inner tube member 22 inside the outer tube member 21 and the outer circumferential surface of the screw rotor 2 can be adjusted will now be explained.

Figure 6:
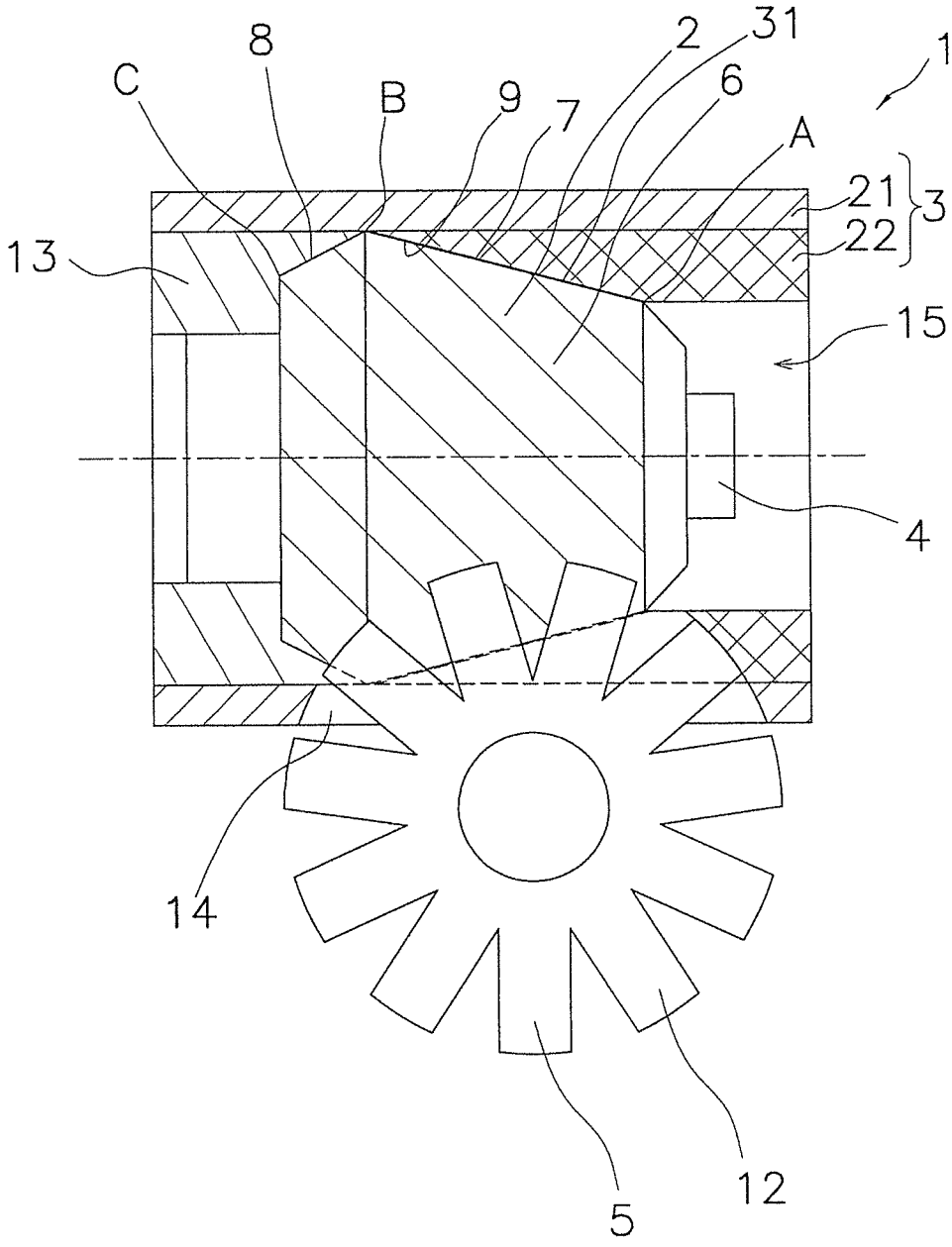
FIG. 6 is a cross sectional view, taken along the IV-IV line in FIG. 1, of the single screw compressor according to a second embodiment of the present invention.
Figure 7:
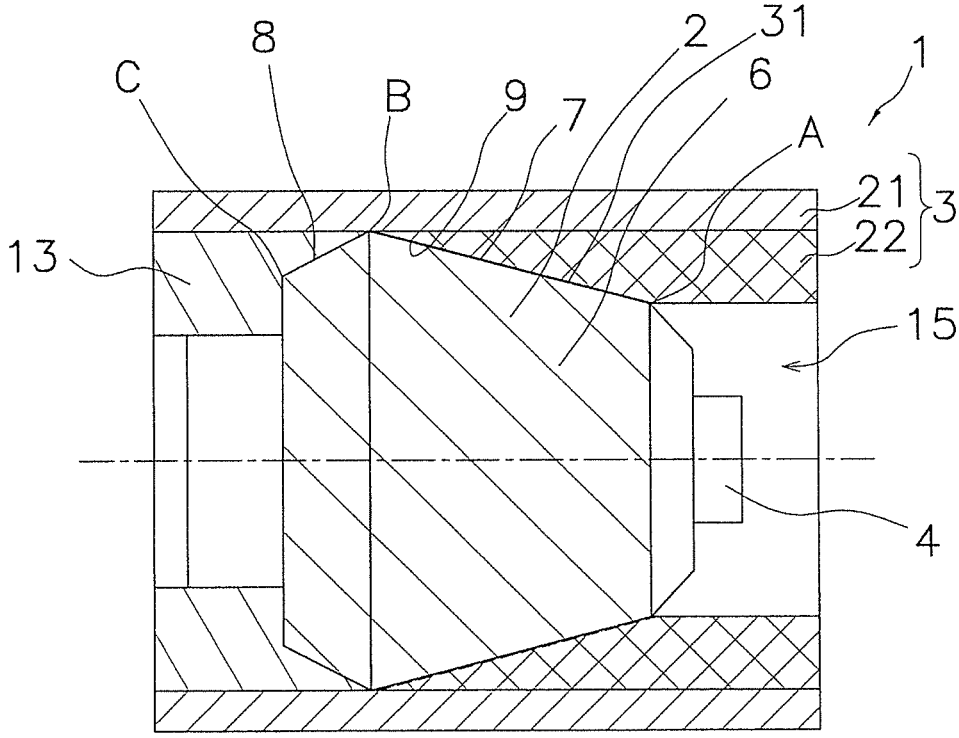
FIG. 7 is a cross sectional view, taken along the V-V line in FIG. 1, of the single screw compressor according to the second embodiment of the present invention.

In the single screw compressor 1 of the second embodiment, the protruding part 23 and the shim 24 of the first embodiment are omitted and, instead, a resin layer 31 is formed by resin coating at least the tapered inner circumferential surface part 9, which is the tapered inner circumferential surface of the inner tube member 22, as shown in FIG. 6 and FIG. 7.

The resin layer 31 is made from a synthetic resin, such as a fluororesin.

The resin layer 31 has a thickness such that it is completely embedded in the gap between the outer circumferential surface of the screw rotor 2 and the tapered inner circumferential surface part 9 of the inner tube member 22.

Other aspects of the present configuration are held in common with the configuration of the screw rotor compressor 1 of the first embodiment.

<Features of the Second Embodiment>

(1) In the second embodiment, the resin layer 31, which is coated on at least the tapered inner circumferential surface part 9 of the inner tube member 22, is formed; therefore, after the assembly of the single screw compressor 1, the gap can be optimally and automatically adjusted by shaving away part of the resin layer 31 with the outer circumferential surface of the screw rotor 2 when the screw rotor 2 is initially rotated. Consequently, it is possible to adjust a minute gap and to reduce leakage of the compressible medium such as refrigerant.

(2) In addition, until the screw rotor 2 initially rotates, the screw rotor 2 is in the state wherein it is fixed by the resin layer 31 in the gap between the screw rotor 2 and the casing 3; therefore, when the single screw compressor 1 is shipped or stored, the resin layer 31 can protect the surface of the screw rotor 2.

<Modified Example of Second Embodiment>

(A) In the second embodiment, the resin layer 31 is formed only on the tapered inner circumferential surface part 9 of the inner tube member 22, but the present invention is not limited to this. In the present invention, the resin layer 31 may be formed such that at least the tapered inner circumferential surface part 9 is resin coated, or the entire inner tube member 22 may be resin coated. In this case, too, the gap can be adjusted optimally and automatically by shaving away part of the resin layer 31 with the outer circumferential surface of the screw rotor 2 when the screw rotor 2 is initially rotated. Consequently, it is possible to adjust a minute gap and to reduce leakage of the compressible medium such as refrigerant.

(B) In addition, the invention of the second embodiment can also be adapted to the invention of the first embodiment.

INDUSTRIAL APPLICABILITY

The present invention can be adapted to a single screw compressor. It is particularly suited to a screw compressor that is built into, for example, a chiller or a heat pump. In addition, it can also be adapted to a variable capacity type compressor.

What is claimed is:

1. A single screw compressor structure comprising:

a tapered screw rotor having a plurality of helical grooves formed in a tapered outer circumferential surface thereof, with an outer diameter of the tapered outer circumferential surface increasing from an inlet side toward a discharge side; and a casing that houses the screw rotor, the casing including an outer tube member having a circular inner hole to form an interior of the outer tube, an inner tube member non-movably fixed to the interior of the outer tube member and having a tapered inner circumferential surface that opposes the tapered outer circumferential surface of the screw rotor, a protruding part protruding radially outwardly from an end part of the inner tube member, and a shim interposed between an end surface of the outer tube member and an end surface of the protruding part.

2. The single screw compressor structure according to claim 1, wherein at least the tapered inner circumferential surface of the inner tube member is resin coated.

3. The single screw compressor structure according to claim 1, wherein the inner tube member is fabricated from a material with a linear coefficient of expansion that is lower than a linear coefficient of expansion of a material of the outer tube member.

4. The single screw compressor structure according to claim 1, wherein the outer tube member and the inner tube member are brazed to each other.

5. A method of assembling a single screw compressor that includes a tapered screw rotor having a plurality of helical grooves formed in a tapered outer circumferential surface thereof, with an outer diameter of the tapered outer circumferential surface increasing from an inlet side toward a discharge side;

a gate rotor having a plurality of teeth that mesh with the helical grooves of the screw rotor; and a casing that houses the screw rotor, the casing including an outer tube member having a circular inner hole to form an interior of the outer tube, and an inner tube member fixed to the interior of the outer tube member and having a tapered inner circumferential surface that opposes the tapered outer circumferential surface of the screw rotor;

the method of assembling comprising:

adjusting mesh between the screw rotor and the gate rotor;

aligning the tapered outer circumferential surface of the screw rotor and the tapered inner circumferential surface of the inner tube member of the casing relative to one another; and integrally coupling the outer tube member and the inner tube member of the casing to each other.

6. The single screw compressor structure according to claim 2, wherein the inner tube member is fabricated from a material with a linear coefficient of expansion that is lower than a linear coefficient of expansion of a material of the outer tube member.

7. The single screw compressor structure according to claim 6, wherein the outer tube member and the inner tube member are brazed to each other.

8. The single screw compressor structure according to claim 2, wherein the outer tube member and the inner tube member are brazed to each other.

9. The single screw compressor structure according to claim 3, wherein the outer tube member and the inner tube member are brazed to each other.

10. The single screw compressor structure according to claim 1, wherein the protruding part and shim are disposed at a reduced diameter end of the tapered outer circumferential surface of the single screw rotor.

* * * * *